US005550530A

United States Patent [19]

Hamm

[11] Patent Number: 5,550,530

[45] Date of Patent: Aug. 27, 1996

[54] DEVICE FOR SUPPLYING POWER TO AND MONITORING AN ELECTRIC FENCE

[76] Inventor: Valery Hamm, Les Pelouses, Route du Lude, 72200 La Fleche, France

[21] Appl. No.: 329,993

[22] Filed: Oct. 27, 1994

[30] Foreign Application Priority Data

Oct. 27, 1993 [FR] France ..... 93 12800

[51] Int. Cl.[6] ..... G08B 13/26

[52] U.S. Cl. ..... 340/564; 340/565; 307/106; 256/10

[58] Field of Search ..... 340/565, 564; 256/10; 307/106; 361/232

[56] References Cited

FOREIGN PATENT DOCUMENTS 0169125 1/1986 European Pat. Off. .
0374055 6/1990 European Pat. Off. .
0381585 8/1990 European Pat. Off. .

*Primary Examiner*—John K. Peng
*Assistant Examiner*—Albert K. Wong
*Attorney, Agent, or Firm*—Young & Thompson

[57] ABSTRACT

A device for supplying power to and monitoring an electric fence, comprising a means connected to an energy source generating high-voltage pulses, a system for digital an electric quantity and a display device, and an alarm circuit.

The digital system comprises a microprogrammed electronic integrated digital circuit which, by means of software, analyzes the status of the fence line and/or its degree of insulation on the basis of the data pertaining to the pulses transmitted along the fence line and/or the data relating to the return pulses sent by a transponder. The digitizing system then sends the results of these analyses to the display device, and transmits data to the alarm circuit via a data transmission channel comprising an electrical insulation.

8 Claims, 2 Drawing Sheets

DEVICE FOR SUPPLYING POWER TO AND MONITORING AN ELECTRIC FENCE

BACKGROUND OF THE INVENTION

1. Field of the Invention

The invention relates generally to electric fences intended to protect any place from the intrusion or exit of an animal or person, such fences being found around enclosures with a view to preventing livestock from getting out.

The dissuasive effect of these fences is due to the transmission of high-voltage pulses of sufficiently high power in the conducting wires forming the fence.

Accordingly, it is of course crucial for users of these fences to be informed of any malfunctioning of the latter.

2. Description of the Prior Art

Devices have already been proposed enabling the status of the fence to be viewed and/or an alarm to be triggered in the event of the fence malfunctioning.

European patent No. 0,374,055 thus displays a status representing the degree of insulation of the fence based on an analysis of the pulses sent through said fence. This analysis is conducted by a circuit powered by the secondary winding of the transformer generating the high-voltage and high-powered pulses.

European patent No. 0,381,585 proposes the monitoring of the presence or absence of a return signal generated by a transponder situated at the end of the fence. The status of the fence is deduced by analysis of the time interval between transmission of the pulse and reception of the return signal. An overrunning of this time interval enables deterioration of the fence to be detected.

Each of these devices only enables one single characteristic representing the status of the fence to be examined and made available to the user.

Known devices are currently all quite voluminous, which makes them difficult to install, and in addition their power consumption is high.

OBJECT OF THE INVENTION

The main object of this invention is to remedy the preceding disadvantages, particularly to provide a compact, low-consumption device that is further capable of providing the user with more data.

SUMMARY OF THE INVENTION

These objects are achieved by using a microcontroller enabling a more powerful tool to be availed of while consuming little power and having small space requirements.

BRIEF DESCRIPTION OF THE DRAWINGS

Further features and advantages of the invention will be clear from the embodiments described hereafter, by way of non limiting examples, with reference to the accompanying drawings in which.

DESCRIPTION OF THE PREFERRED EMBODIMENTS

Figure 1:
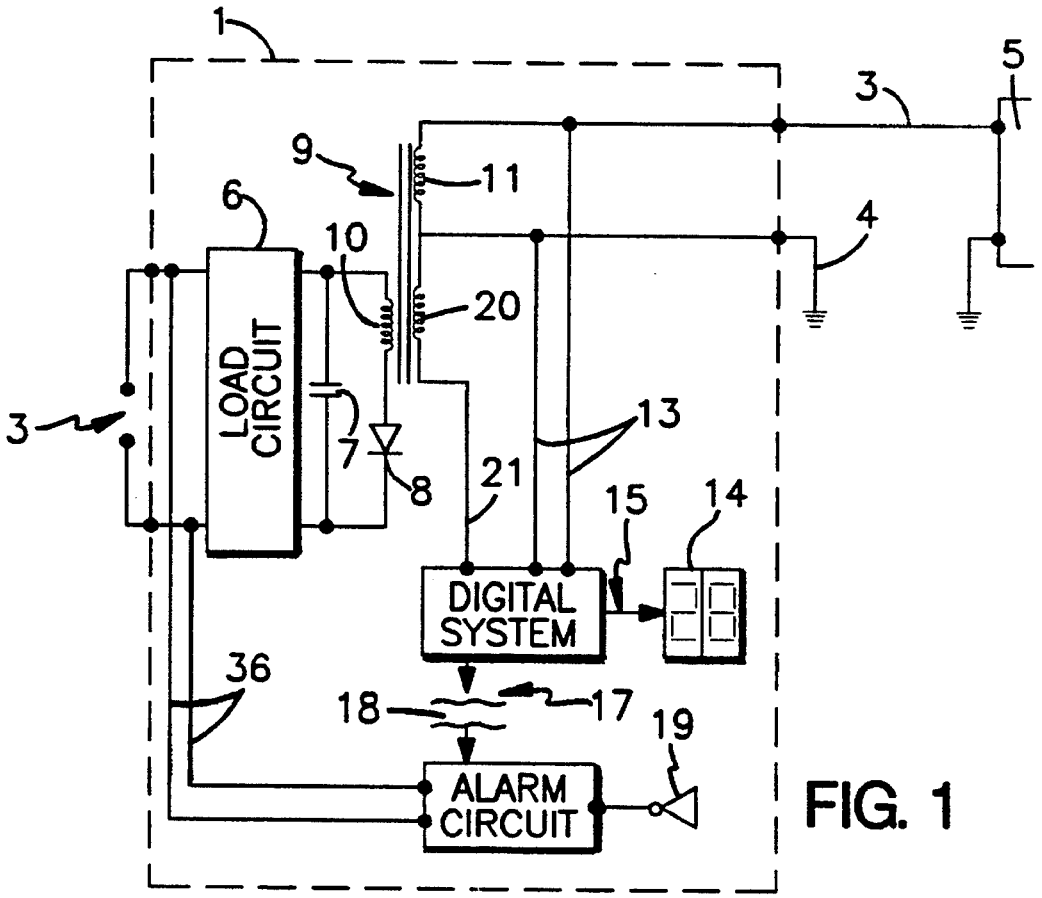
FIG. 1 schematically shows a first embodiment of the invention.

Referring first to FIG. 1, an electric fence circuit according to the present invention can be recognized in which a box 1 encloses a means of generating pulses along the fence line 3.

The pulse generating means is comprised of a capacitor 7 load circuit 6 supplied by a power source 2, a thyristor 8 and a transformer 9.

In a known manner, the power source 2 can be in different forms, e.g. public mains supply of alternating current, battery, cell, solar panel, etc., the load circuit 6 being suited to the power source 2 used.

The fence line 3 is grounded at 4 and can comprise a transponder 5 disposed at its end and whose purpose it is to transmit a return signal to the box 1 via the fence line 3 and the ground 4.

The load circuit 6 provides the load to the capacitor 7, whereas the thyristor 8 ensures periodical discharge thereof to the primary winding 10 of the transformer 9.

High-voltage pulses are then emitted by the secondary winding 11 of the transformer 9 into the fence line 3, and return via the ground 4.

The fence status monitoring and viewing device is globally comprised of a digital system 12, a display device 14 and an alarm circuit 16.

According to the invention, the digital system is a microprogrammed electronic integrated digital circuit of the microprocessor or microcontroller type. This circuit uses the software it stores to perform numerous analysis tasks. It is thus capable of analyzing, on request by the user, the status of the fence line 3, the degree of insulation thereof, the working order of the box 1 and/or of issuing a self-diagnostic. These analyses are conducted on the basis of the data pertaining to the pulses sent along the fence line and/or of the data relating to the return pulses transmitted by a transponder 5 in the event of such a transponder being provided in the fence line, these data being routed to the digital system 12 by the line 13 connecting it to the fence line 3 and ground.

This digital circuit is supplied with energy by a line 21 connecting it to an additional secondary winding 20 of the transformer 9.

This powering of the digital circuit 12 by means of the energy source intended for the dissuasive pulses, without any risk of disturbing the operating of the fence line, is made possible by the utilisation of programmed integrated circuits requiring little energy to operate.

After analyzing the different parameters requested, the digital circuit 12 transmits, via the bus 15, the results of these analyses to a display device 14 of any type one wishes.

The display device 14 also only requires very little energy to operate, which advantageously enables it to be powered by the additional secondary winding 20 via the digital circuit 12.

The bus 15 thus ensures transmission of the data at the same time as supplying electricity for said display device 14.

The digital circuit 12 is also connected by a data transmission channel 17 to the alarm circuit 16 in order to efficiently warn the user in the event of malfunctioning of the electric fence.

This alarm circuit 16 is connected to an audible or luminous device 19.

This audible or luminous device 19 needs a large quantity of energy to operation as it is required to be capable of effectively alerting the user. It cannot therefore be powered by the transformer 9 via the digital circuit 12 as described above with regard to the display device 14. It is for this reason that a line 36 is disposed between the alarm circuit 16 and the energy source 2 at a point of the latter upstream of the load circuit 6. In order to electrically insulate the digital circuit 12 from the alarm circuit 16, the data transmission channel 17 comprises an electrical insulation 18.

Figure 2:
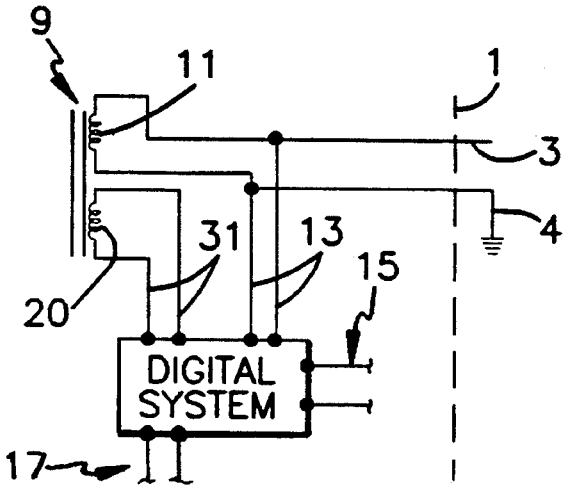
FIG. 2 is a partial schematic view of another embodiment of the device in FIG. 1.

In the embodiment of part of the device represented in FIG. 2, the secondary winding 11 and the additional secondary winding 20 of the transformer are electrically separated from one another. The digital circuit 12 is then powered by a line 31 that is electrically connected to said additional secondary winding 20 of the transformer. The digital circuit then receives, on the one hand, the energy it requires to operate via the line 31, and on the other hand, the data pertaining to the pulses transmitted along the fence line 3 via the line 13. However, said digital circuit continues to be powered by the energy supplied to the pulses.

Figure 3:
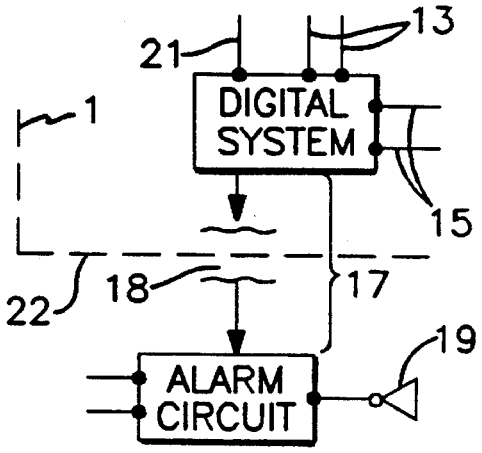
FIG. 3 is a partial schematic view of yet another embodiment of the device in FIG. 1.

FIG. 3 shows another embodiment of another part of the device in FIG. 1. This embodiment relates to the alarm circuit.

In this embodiment, the alarm circuit 16 and the alarm device 19 are situated outside of the box 1, which enables them to be positioned in locations more or less distant from the electric fence and in which there will be a greater certainty of the user perceiving the alarm.

The data transmission channel 17 must then pass through the wall 22 of the box 1 and, for elementary safety reasons, the electric insulation 18 will of course be disposed at the level of this wall 22 in order to eliminate all risks of electric shock.

Figure 4A:
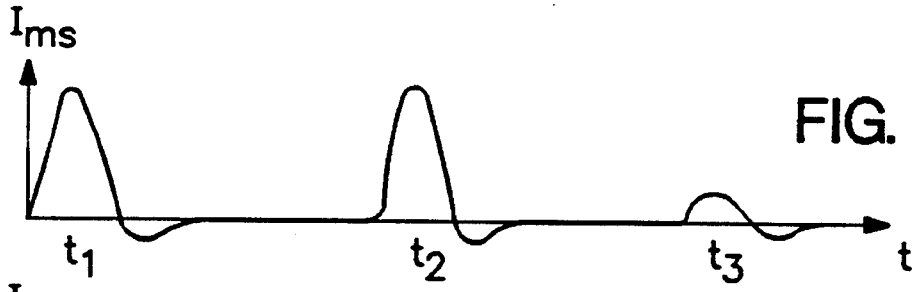
FIG. 4 illustrates the form in which the data are transmitted to the alarm circuit.
Figure 4B:
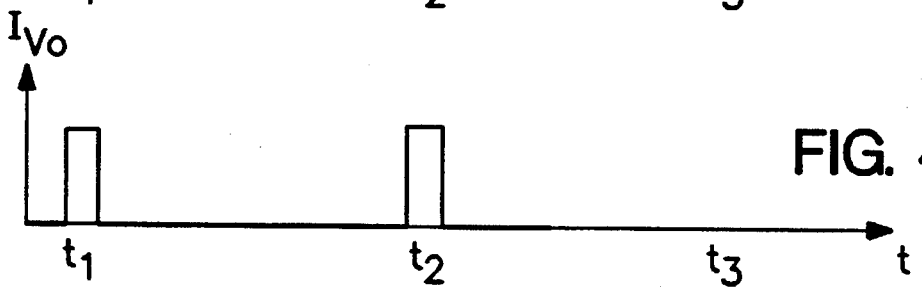

FIG. 4 shows the data received by the alarm circuit 16. The upper graph represents the pulses Ims transmitted along the electric fence while the lower graph represents the pulses Ivo received by said alarm circuit 16 subsequent to the data processing performed by the digital circuit 12.

When the level of the pulse transmitted along the electric fence is normal, as represented at t1 and t2, the alarm circuit 16 receives a pulse of a duration of less than 1 ms synchronized with the pulse transmitted along the fence line, whereas when the level of the pulse transmitted along the fence is abnormally low, as represented at t3, the alarm circuit 16 does not receive the pulse which, for the alarm circuit, causes the triggering of an alarm warning the user that the device is not functioning properly.

This alarm circuit 16 not only enables warning to be given of a malfunctioning of the fence, but also of any malfunctioning of the digital circuit 12, data transmission channel 17 or power supply circuit 21 or 31.

By reading the data available on the display device 14, the user warned by the alarm circuit 16 can then interpret the malfunctioning of the fence.

Figure 5:
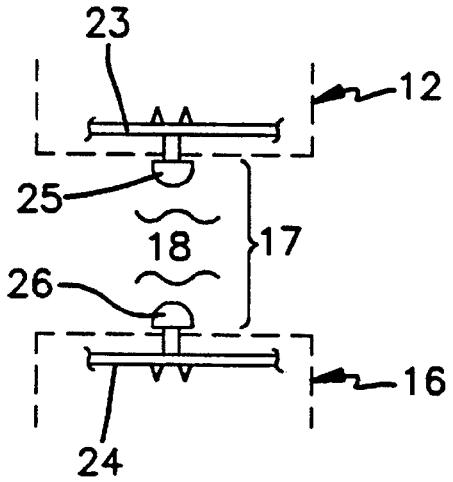
FIGS. 5 to 7 illustrate further embodiments of the electrically insulated transmission of data to the alarm circuit.
Figure 6:
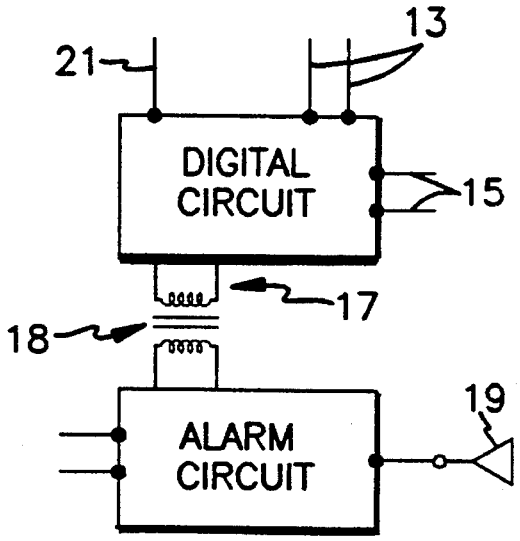
Figure 7:
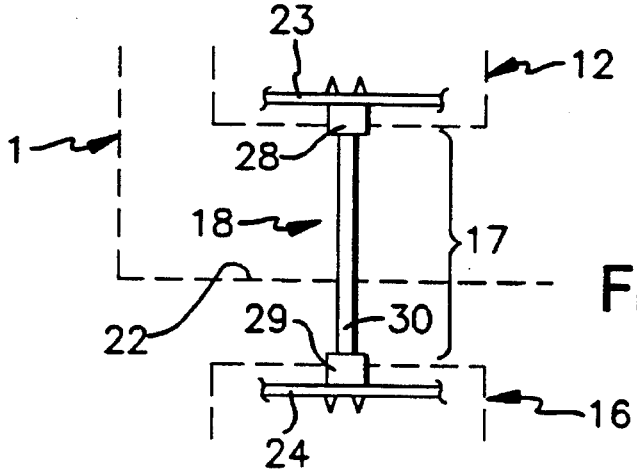

FIGS. 5 to 7 show examples of embodiments of the data transmission channel 17 that can be envisaged.

In FIG. 5, the digital circuit 12 comprises at least one printed circuit board 23 bearing a transmitter 25, whereas the alarm circuit comprises a printed circuit board 24 bearing a receiver 26.

The transmitter 25 and the receiver 26 are aligned in order for the data transmitted from the digital circuit 12 to be received by the alarm circuit 16.

The transmitter and receiver are far enough apart from one another to ensure the electrical insulation 18 required. This distance will be at least four centimeters in order to provide an insulation of the order of 10 kV.

The transmitter and receiver can be of any type one wishes, e.g. optoelectronic components using infrared radiation or components using ultrasonic waves.

In the embodiment represented in FIG. 6, the data transmission channel 17 is comprised of a transformer whose primary winding receives the data from the digital circuit 12 before transmitting them to the secondary winding connected to the alarm circuit 16. The electrical insulation 18 is the insulation existing between the primary and secondary windings of the transformer.

The other embodiment represented in FIG. 7 uses an optical fiber 30 connecting a transmitter 28 borne by a printed circuit board 23 of the digital circuit 12 to a receiver 29 borne by a printed circuit board 24 of the alarm circuit 16. This optical fiber can of course run through the wall 22 of the box 1.

This embodiment has the advantage of enabling the alarm circuit to be positioned in any place one wishes, even at a distance from the box 1 by using an optical fiber of great length. Furthermore, in this embodiment, the receiver need not necessarily be positioned in strict alignment with the transmitter.

I claim:

1. A device as for supplying power to and monitoring an electric fence line intended to pen in livestock or to prevent intrusion into an enclosure, comprising a high-voltage pulse generating means connected to a source of energy, said high-voltage pulse generating means generating high-voltage pulses, a system for digitizing an electric quantity, said digitizing system being connected to and drawing electric energy for operating from said energy source, a display device connected to said digitizing system, said display drawing electrical energy for operating from said energy source via said digitizing system, wherein said digitizing system comprises a microprogrammed electronic integrated digital circuit which, by means of software, analyzes at least one of a status of the fence line and a degree of insulation of said fence line on the basis of data pertaining to at least one of pulses transmitted along the fence line and data relating to return pulses sent by a transponder, said digital circuit comprising means for sending results of these analyses to said display device, said digital circuit also comprising means for transmitting data to an alarm circuit connected to said digital circuit via a data transmission channel comprising electrical insulation.

2. The device as claimed in claim 1, wherein when a level of said pulses transmitted along the electric fence line is high, the alarm circuit receives a data pulse from the digital circuit, via the data transmission channel, whereas when the level of said pulses transmitted along the fence is low, said alarm circuit does not receive any data pulse from said digital circuit.

3. The device as claimed in claim 2, wherein reception of a data pulse by the alarm circuit represents normal functioning of the fence line and of said power supplying and monitoring device, whereas failure to receive a data pulse represents, for said alarm circuit, faulty functioning of said fence line and of said power supplying and monitoring device and triggers an alarm warning a user that said power supplying and monitoring device is malfunctioning.

4. The device as claimed in claim 1, wherein the data transmission channel comprises a transmitter and a receiver separated by a distance ensuring electrical insulation, said distance being a distance sufficient to ensure an electrical insulation of about 10 kV.

5. The device as claimed in claim 4, wherein said transmitter and receiver are infrared radiation optoelectronic components.

6. The device as claimed in claim 4, wherein said transmitter and receiver receive and transmit ultrasonic waves, respectively.

7. The device as claimed in claim 4, wherein said transmitter and receiver are connected to one another by an optical fiber.

8. The device as claimed in claim 1, wherein the data transmission channel comprises a transformer whose primary winding is connected to and receives data from the digital circuit, said transformer transmittinq said data to a secondary winding of said transformer connected to the alarm circuit.

* * * * *